US005634357A

United States Patent [19]

Nutter et al.

[11] Patent Number: 5,634,357

[45] Date of Patent: Jun. 3, 1997

[54] ENCLOSURE HANDLE

[75] Inventors: Curtis F. Nutter, Anoka, Minn.; Jim I. Myers, Decorah, Iowa

[73] Assignee: Federal-Hoffman, Inc., Anoka, Minn.

[21] Appl. No.: 398,561

[22] Filed: Mar. 3, 1995

[51] Int. Cl.[6] ..... E05B 13/10; G05G 5/00

[52] U.S. Cl. ..... 70/210; 70/203; 70/212; 70/224; 70/452; 70/379 R

[58] Field of Search ..... 70/201, 202, 210, 70/211, 212, 379 R, 248, 245, 224, 261, 452; 292/244

[56] References Cited

U.S. PATENT DOCUMENTS

| | | | |
|---|---|---|---|
| 1,499,444 | 7/1924 | Caillois | 70/361 |
| 1,565,858 | 1/1925 | Sells et al. | 70/212 |
| 2,013,055 | 9/1935 | Kerwin, Jr. | 70/422 |
| 2,050,696 | 8/1936 | Schourel | 70/361 |
| 2,939,308 | 7/1960 | Trammell, Jr. | 70/211 |
| 3,950,971 | 4/1976 | Karls | 70/164 |
| 4,498,320 | 2/1985 | Mullis | 70/212 |
| 4,871,203 | 10/1989 | Rogers | 292/244 |
| 5,107,692 | 4/1992 | Chen | 70/379 R |
| 5,115,834 | 5/1992 | Champagne | 70/212 |
| 5,263,348 | 11/1993 | Wittwer | 70/422 |

FOREIGN PATENT DOCUMENTS

| | | | |
|---|---|---|---|
| 3510439 | 9/1986 | Germany | 70/224 |
| 692503 | 6/1953 | United Kingdom | 70/212 |
| 9006412 | 6/1990 | WIPO | 70/224 |

OTHER PUBLICATIONS

P. 502 of Hoffman Engineering Company Specifier's Guide, 1995–1996, showing lock kits for enclosures and junction boxes.

Pp. 574–575 of Hoffman Engineering Company Specifier's Guide, 1995–1996, showing handles, latches and clamps for use on Hoffman custom enclosures.

Cover page of a DECO brochure, dated Apr., 1993, showing a latch handle.

*Primary Examiner*—Darnell M. Boucher

*Attorney, Agent, or Firm*—Merchant, Gould, Smith, Edell, Welter & Schmidt

[57] ABSTRACT

A latch handle (20) includes a grip portion (22) and a housing portion (24) with a spindle (28) extending therefrom to actuate a latch. The handle (20) rotates about an escutcheon (26) and is configured for receiving two or more padlocks. The handle grip portion (22) includes a padlock receiving portion (32) while the escutcheon (26) has a raised portion (34) aligning with the lock receiving portion (32). The escutcheon (26) takes on a second embodiment (126) for rotation in an opposite direction. A defeater device (30) includes a retainer (40) coupled to a plunger member (50). The plunger member (50) slides axially within a bore (70) and rotates relative to an insert (60). The insert includes a cammed surface (62) which receives tabs (52) of the plunger member (50). The plunger member (50) is biased by compression spring (48) and torsion spring (56) to urge the tabs (52) against the cammed surface (62) so that the plunger member (50) moves axially as the retainer (40) is rotated.

12 Claims, 7 Drawing Sheets

ENCLOSURE HANDLE

BACKGROUND OF THE INVENTION

1. Field of the Invention

The present invention is directed to a latch, and in particular to a latch having a rotatable handle with an integrally mounted defeater device.

2. Description of the Prior Art

Latches for very large enclosures take on many different embodiments which are well known. However, improvements are possible in the enclosure handle field. Therefore an objective of the present invention to incorporate tool actuation of the defeater to rotate the handle and open the latch. In addition, the handle should accommodate either 3 5/16" locks or 2⅜" locks or multiple locking of the handle. The tool actuating the defeater mechanism should require one of any number of tools, such as a screwdriver, for opening.

In addition, the latch should rotate 90 degrees in either a clockwise or a counter-clockwise direction. Previous designs have limited rotation to one direction for opening and do not easily accommodate rotation in the other direction.

The latch should have hidden fasteners and internal screws and meet NEMA 12 and NEMA 4 standards to insure that the latch prevents entrance of gases, water and oil through the handle portion. The handle should therefore be sealed and prevent migration through the defeater and mounting hardware or through the spindle.

Prior handle devices have required a separate defeater mechanism for the lock. It can be appreciated that it is desireable to have an integral defeater mechanism to more easily meet the Nema requirements as well as for aesthetic and manufacturing reasons.

It can be seen then that a new and improved latch handle is needed which includes an integrally mounted defeater mechanism. In addition, the defeater mechanism should provide for actuation with a tool and should snap between the locked and the unlocked position. The rotation of the handle to actuate should be within a limited range and should be easily switchable between clockwise and counter-clockwise rotation for actuation. In addition, handles should accommodate several padlocks for locking the handle. The present invention addresses these as well as other problems related to large enclosure latch handles.

SUMMARY OF THE INVENTION

The present invention is directed to a latch handle such as may be used with very large enclosures. The present invention includes a handle which rotates about a fixed base or escutcheon. The handle includes a grip portion and base portion with a padlock receiving member extending from the grip towards the base. The padlock receiving portion is configured to receive two or three padlocks for providing additional security. In addition, the present invention includes a defeater mechanism which requires a tool to actuate and prevents accidental opening when the padlocks have been removed.

The padlock receiving member of the grip is substantially centered so that the handle and base are configured for rotating in either direction. However, the escutcheon includes a complementary padlock receiving member which is offset to one side or the other and which limits rotation of the handle to one direction from the locked position. It can be appreciated that two different embodiments of the escutcheon are utilized for having the handle rotate either clockwise or counter-clockwise. The base also includes rotation limiting members engaging the defeater so that rotation of the handle is restricted to a predetermined range.

The defeater mechanism is integrally mounted in a bore extending through the housing portion of the handle. The defeater mechanism includes a retainer member which may be slotted or otherwise configured for receiving a tool to actuate the defeater mechanism. The retainer includes a spring loaded clip which abuts a ledge in the bore to hold the retainer in place. At an opposite end of the bore, is an enlarged chamber. The chamber receives an insert which has a camming surface, or the chamber is otherwise configured to include a camming surface extending radially along the edge of the bore. The camming surface receives tabs from a defeater plunger member which rides on the cammed surface and is slidably mounted axially in the bore. The plunger member includes a compression spring and a torsion spring to urge the plunger toward a locked position. The plunger member engages retainer member and rotates as the retainer member is rotated. A recess in the escutcheon receives the plunger member to lock the defeater mechanism.

It can be appreciated that the present invention includes an integrally mounted defeater and hardware for the defeater so that the latch and handle provide a more airtight and watertight enclosure. In addition, the spindle extending from the handle inserts into a recess formed in the handle housing, but which does not extend all the way through the housing so that fluids and gases may not leak through. The escutcheon and housing also include gaskets to provide a better seal.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals designate corresponding elements throughout the several views.

DETAILED DESCRIPTION OF THE PREFERRED EMBODIMENT(S)

Figure 3:
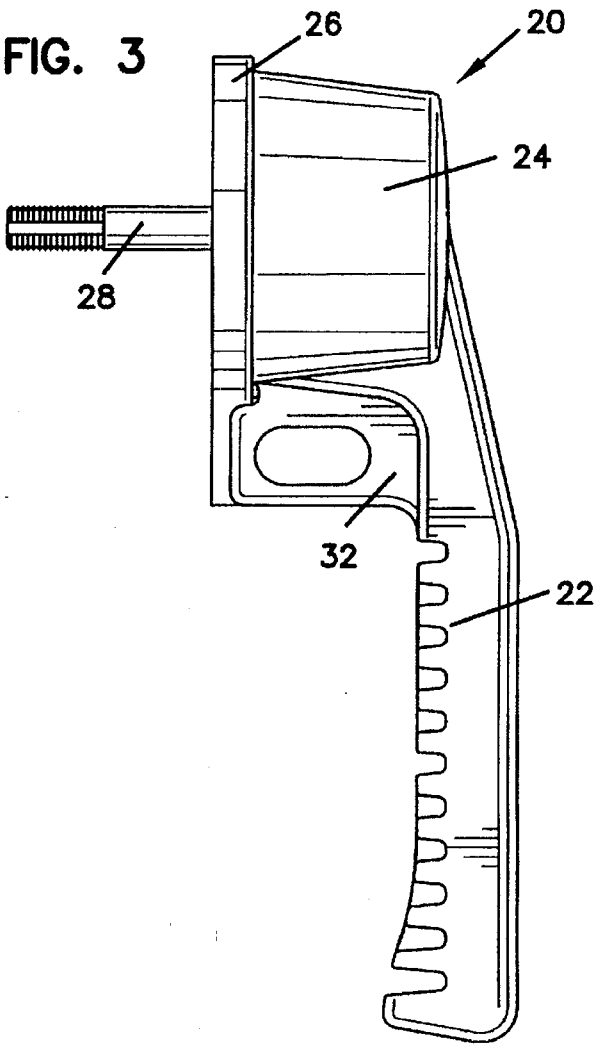
FIG. 3 shows a left side elevational view of the latch shown in FIG. 1.
Figure 2:
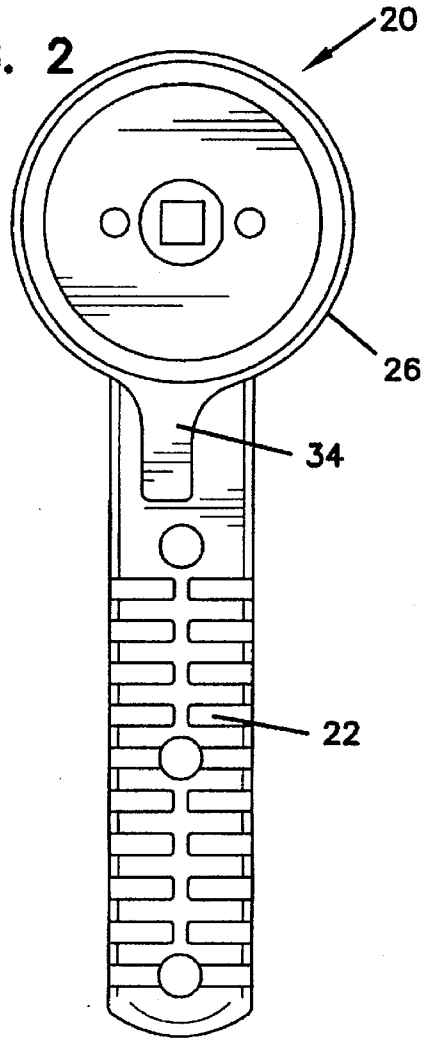
FIG. 2 shows a rear elevational view of the latch shown in FIG. 1.
Figure 1:
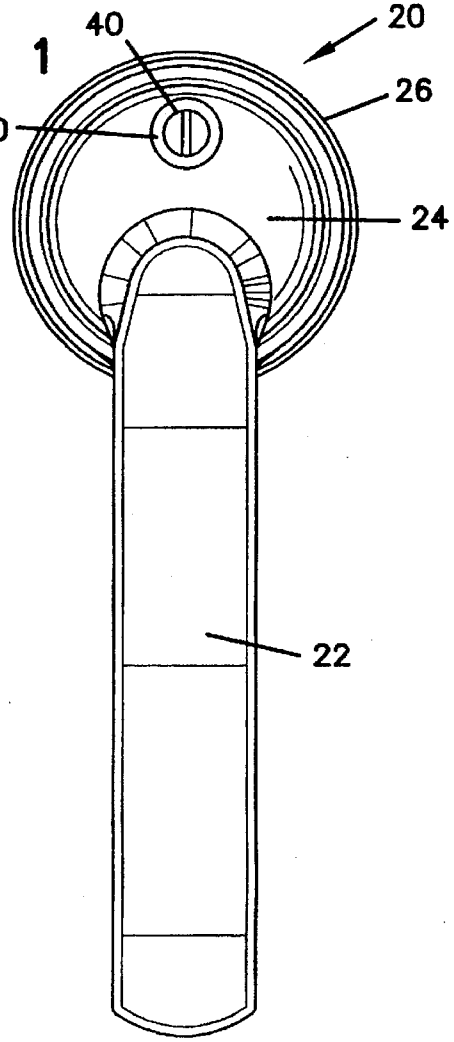
FIG. 1 shows a front elevational view of a latch according to the principles of the present invention.
Figure 4:
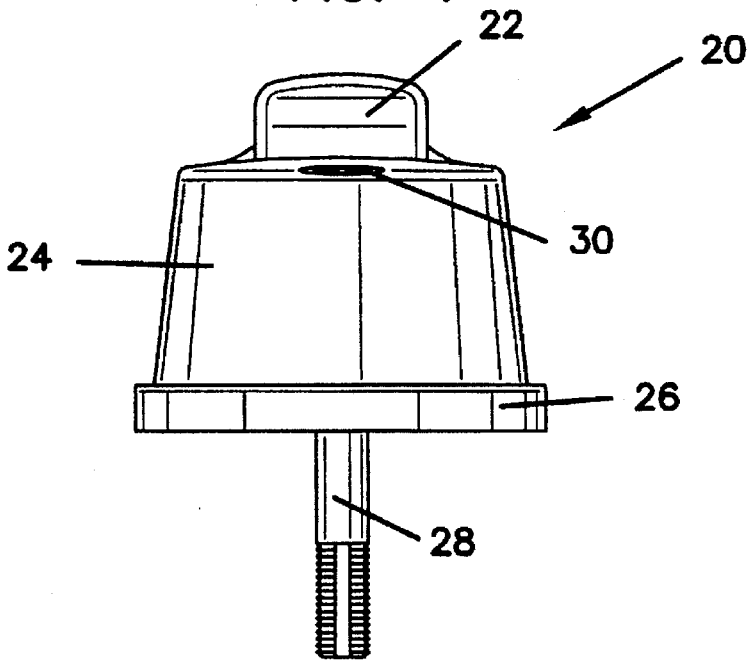
FIG. 4 shows a top plan view of the latch shown in FIG. 1.

Referring now to the drawings, wherein like reference numerals designate corresponding structure throughout the views, and referring in particular to FIG. 1, there is shown a latch handle, generally designated 20. The latch handle 20 is generally used for large enclosure latches which require turning in order to open. The latch handle 20 includes a handle grip portion 22 extending from a housing portion 24. The housing portion 24 mounts on an escutcheon 26 and rotates relative to the escutcheon 26. The escutcheon 26 is generally mounted to the door or other enclosure surface to which the latch is an actuator. As shown in FIG. 3, a spindle 28 extends outward from the housing portion 24 and through the escutcheon 26. As shown in FIGS. 2 and 3, the escutcheon 26 is configured to mount flat against the enclosure or door and only requires holes for mounting and for receiving the spindle. In this manner, leakage through the enclosure is eliminated and the handle 20 meets NEMA 12 and NEMA 4 standards. A lock defeater 30 includes a retainer 40 which is slotted for receiving a tool, as shown most clearly in FIGS. 1 and 4.

Figure 5:
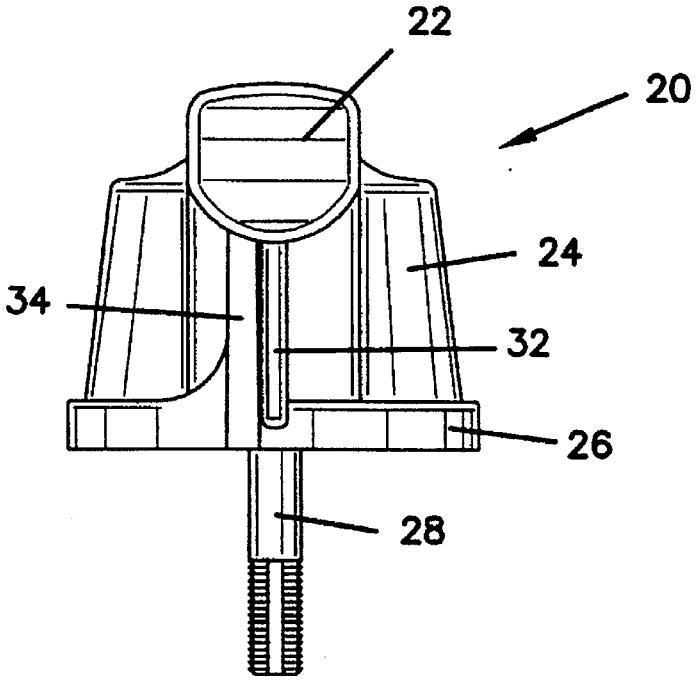
FIG. 5 shows a bottom plan view of the latch shown in FIG. 1.
Figure 6:
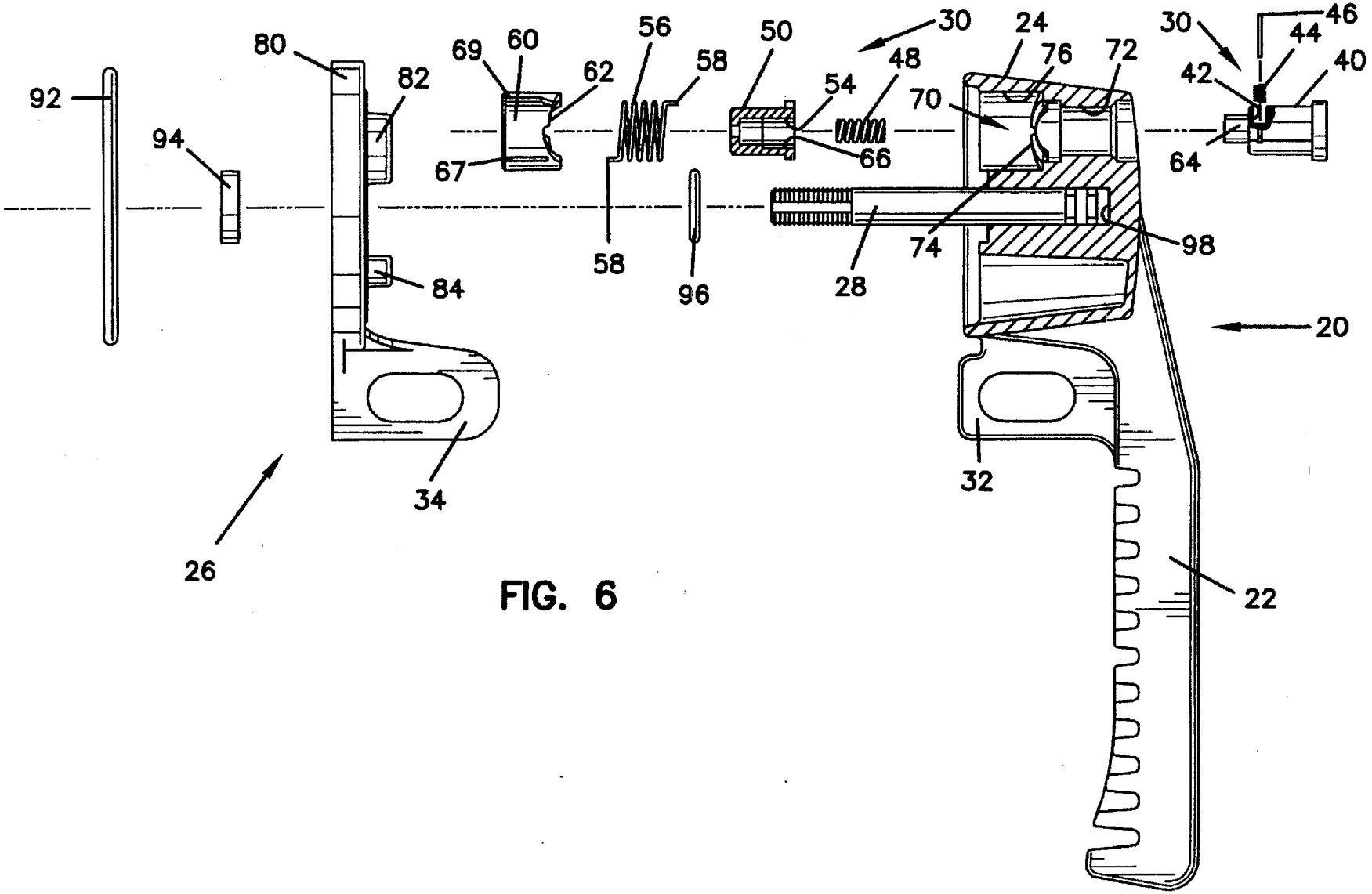
FIG. 6 shows an exploded side view of the latch shown in FIG. 1.

As shown in FIGS. 3 and 5, the handle portion 22 also includes a lock receiving member 32. The lock receiving member 32 includes an elongated orifice for receiving two or three padlocks or other locking devices. It can be appreciated that with the configuration shown, two ⅜" padlocks may be inserted or three 5/16" padlocks may be inserted through the opening. The escutcheon 26 includes a raised lock receiving portion 34, as shown in FIGS. 2 and 5. The escutcheon lock receiving portion 34 also includes an orifice as shown in FIG. 6, which aligns with the orifice on the handle lock receiving portion 32. It can be appreciated that the handle 22 is able to rotate in only one direction away from the escutcheon lock receiving portion 34.

As shown most clearly in FIG. 5, the lock receiving member 32 of the handle 20 is centered the escutcheon lock receiving portion 34 is offset. Therefore, the handle portion 22 and the lock receiving portion 32 may be utilized for rotation in either direction. When in the embodiment shown in FIGS. 2–6, the escutcheon shown is configured for allowing rotation in the clockwise direction away from the escutcheon lock receiving portion 34 to actuate the latch 20.

Figure 9:
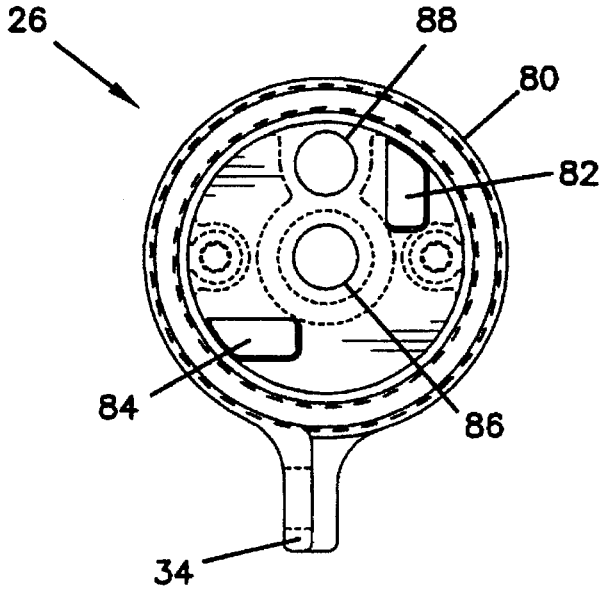
FIG. 9 shows a top plan view of the escutcheon for the latch shown in FIG. 1.
Figure 12:
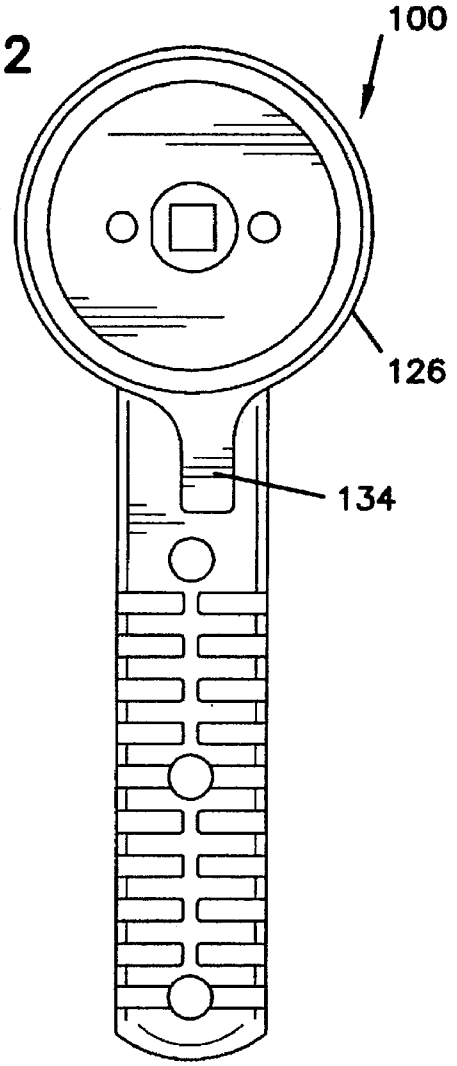
FIG. 12 shows a rear elevational view of a second embodiment of the latch shown in FIG. 1.
Figure 13:
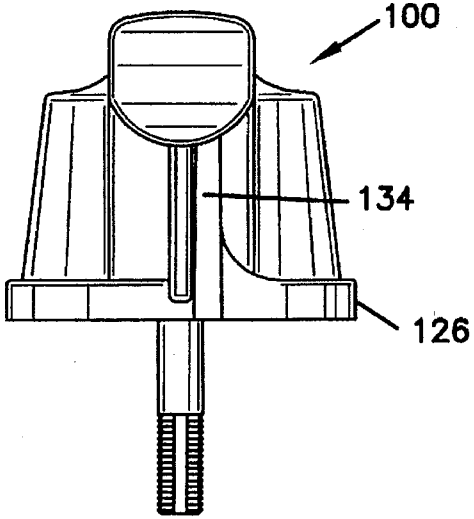
FIG. 13 shows a bottom plan view of the latch shown in FIG. 12.
Figure 14:
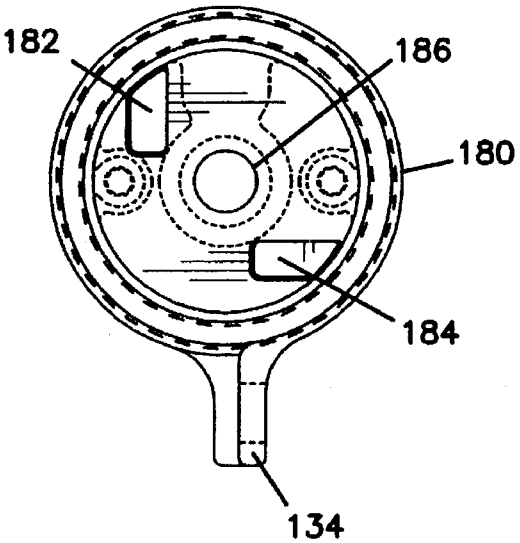
FIG. 14 shows a top plan view of the escutcheon for the latch shown in FIG. 12.

Referring to FIGS. 12–14, there is shown a second embodiment, generally designated 100, which is configured for actuation in the counter-clockwise direction away from an escutcheon lock receiving portion 134 of an escutcheon 126. It can be appreciated that the escutcheons 26 or 126 are interchangeable to switch the direction's rotation between clockwise and counter-clockwise. The handle 26 and housing 24 are used with either escutcheon 26 or 126. Referring now to FIGS. 9 and 14, and in particular to FIG. 9, the escutcheon 26 includes a base portion 80 with a central orifice 86 and a recess 90 for receiving the defeater mechanism, as explained hereinafter. Rotation limiting members 82 and 84 extend upward from the base 80, as shown more clearly in FIG. 6. The raised members 82 and 84 limit rotation of the plunger portion of the defeater mechanism, as explained hereinafter. In a similar manner, as shown in FIG. 14, the escutcheon 126 includes rotation limiting members 182 and 184. These are placed in a mirror image corresponding to the positioning shown in FIG. 9 with the lock receiving member 134 also mirroring the configuration of member 34 shown in FIG. 9. It can be appreciated that the escutcheons 26 and 126 are easily interchangeable for switching the direction of rotation.

Figure 7:
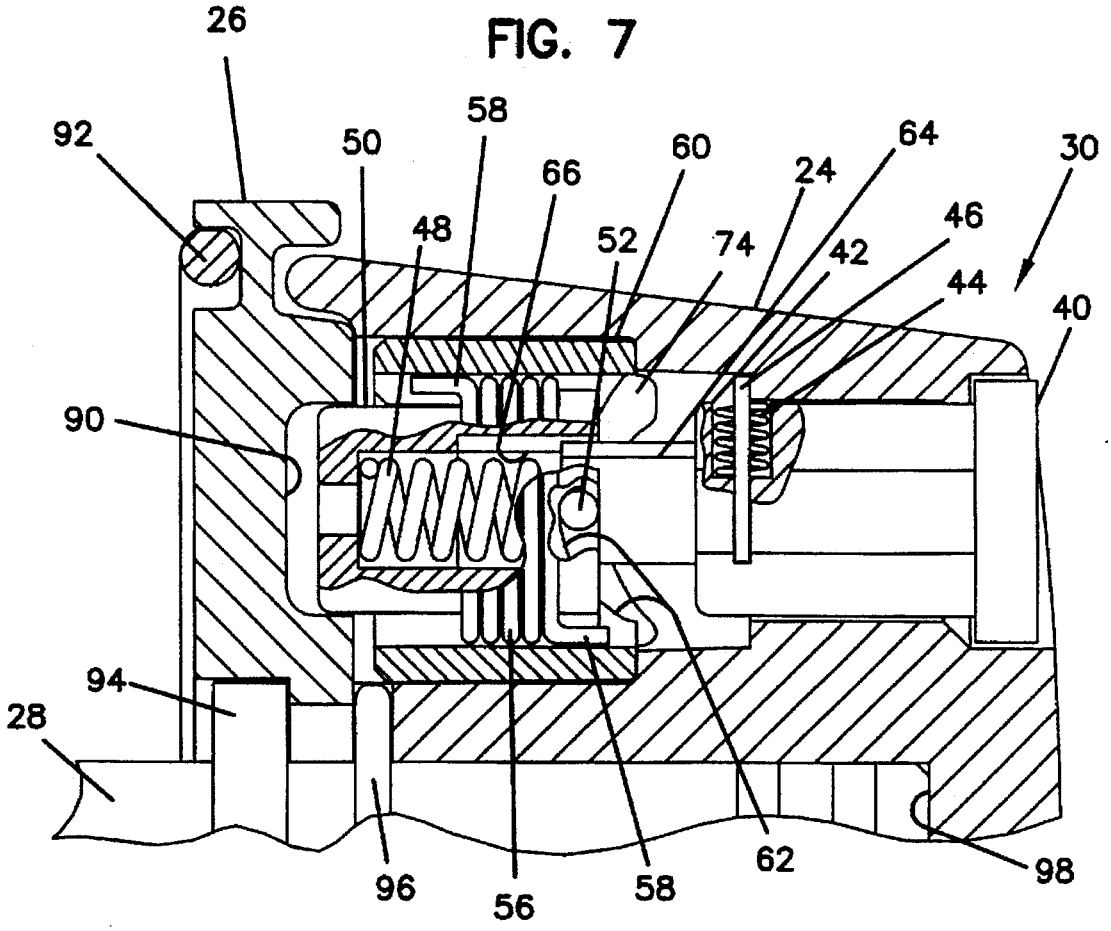
FIG. 7 shows a detail sectional view of the defeater device for the latch shown in FIG. 1 in the locked position.
Figure 8:
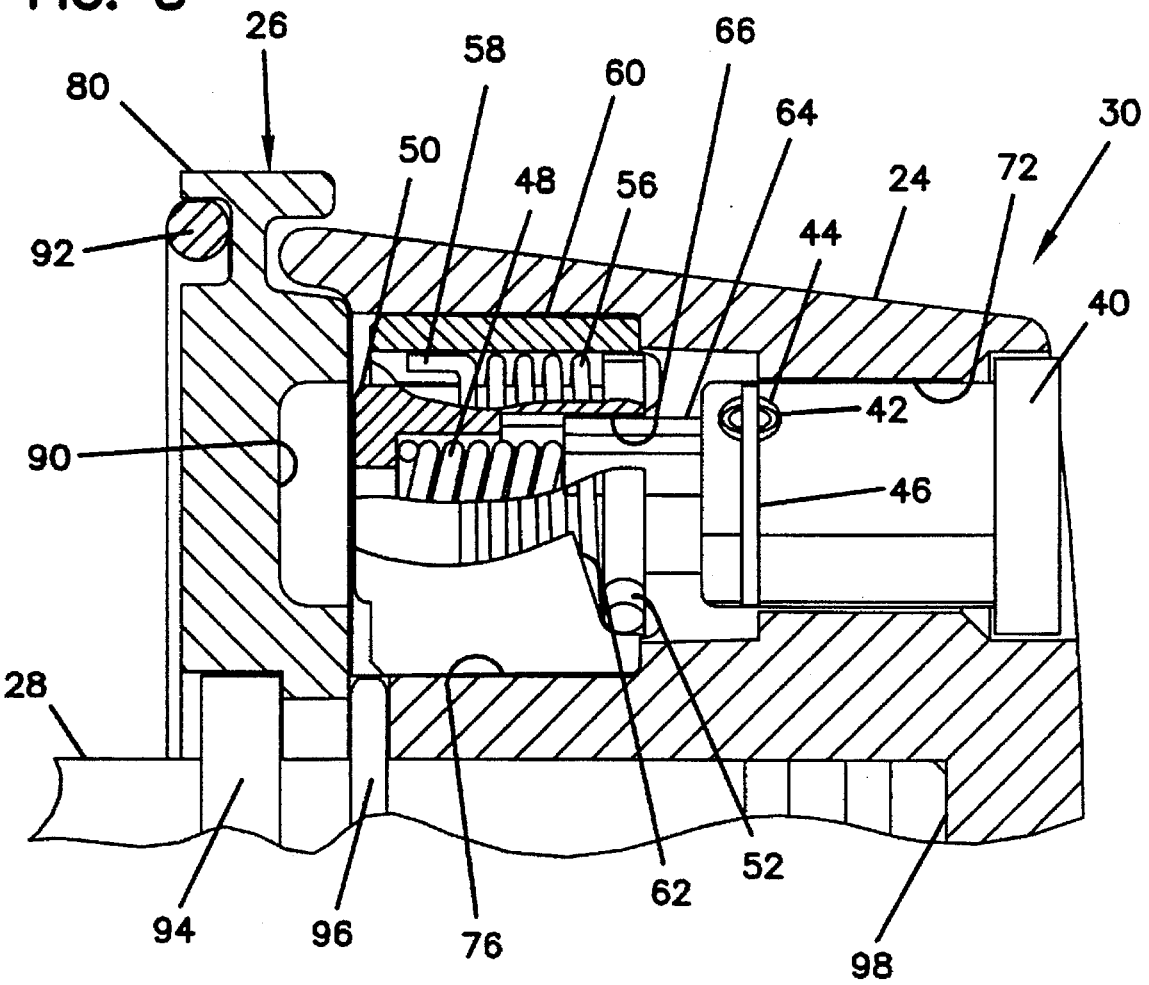
FIG. 8 shows a detail sectional view of the defeater device for the latch shown in FIG. 1 in the unlocked position.

Referring now to FIGS. 6–8, there is shown the internal mechanism for the defeater device 30. To accommodate the defeater 30, the housing portion 24 of the handle 20 includes a bore 70 formed therethrough. In the embodiment shown, the defeater 30 is placed directly above the spindle 28. It can be appreciated that with the defeater 30 placed in the housing 24, a separate remote defeater is not required with separate mounting hardware, as is done with prior art devices. The bore 70 includes a retainer receiving portion 72 which narrows to receive a retainer 40. In addition, at an opposite end of the bore 70 is formed an enlarged insert receiving portion 76 forming a shoulder 74. The retainer 40 includes a slot 42 which receives a small radially extending compression spring 44 and retaining clip 46. The spring 44 is placed against the retainer 40 and clip 46. The clip 46 is substantially horseshoe shaped and includes legs extending around the spring and has barbs engaging a small slot below the main slot 42 to retain the clip 46 against the retainer 40 and to hold the spring 44 in the slot 42. The spring 44 provides constant tension against the clip 46. Therefore, when the retainer 40 is inserted into the narrowed portion 72 of the bore 70, the ramped entrance to the narrowed portion 72 pushes the clip 46 radially inward so that the retainer 40 may be inserted further into the bore 70. When the retainer 40 has been inserted a sufficient distance, the clip 46 will extend inward beyond the narrowed retainer receiving portion of the bore 72 and past the ledge formed by the narrowed portion 72. At this point, the compression spring 44 pushes the clip 46 outward to abut the shoulder formed by the narrowed portion 72, so that the retainer 40 may not be withdrawn, as shown in FIG. 7.

Figure 10:
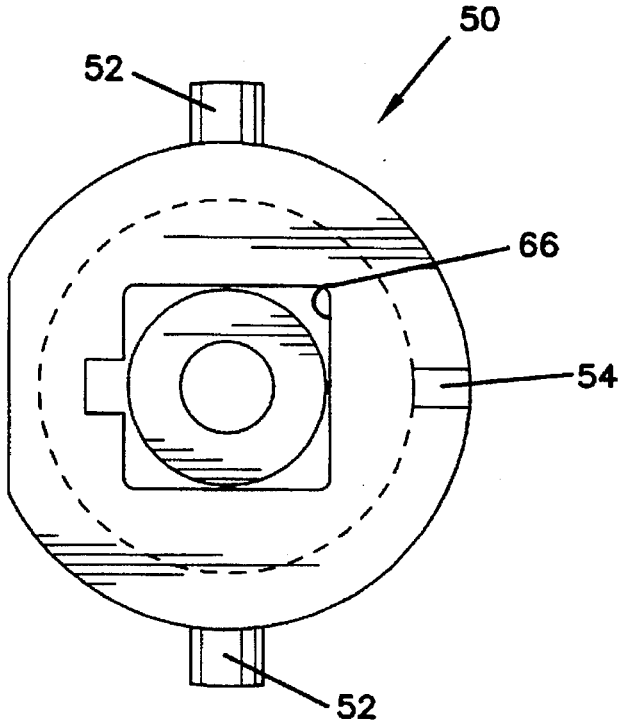
FIG. 10 shows top plan of the defeater plunger member.
Figure 11:
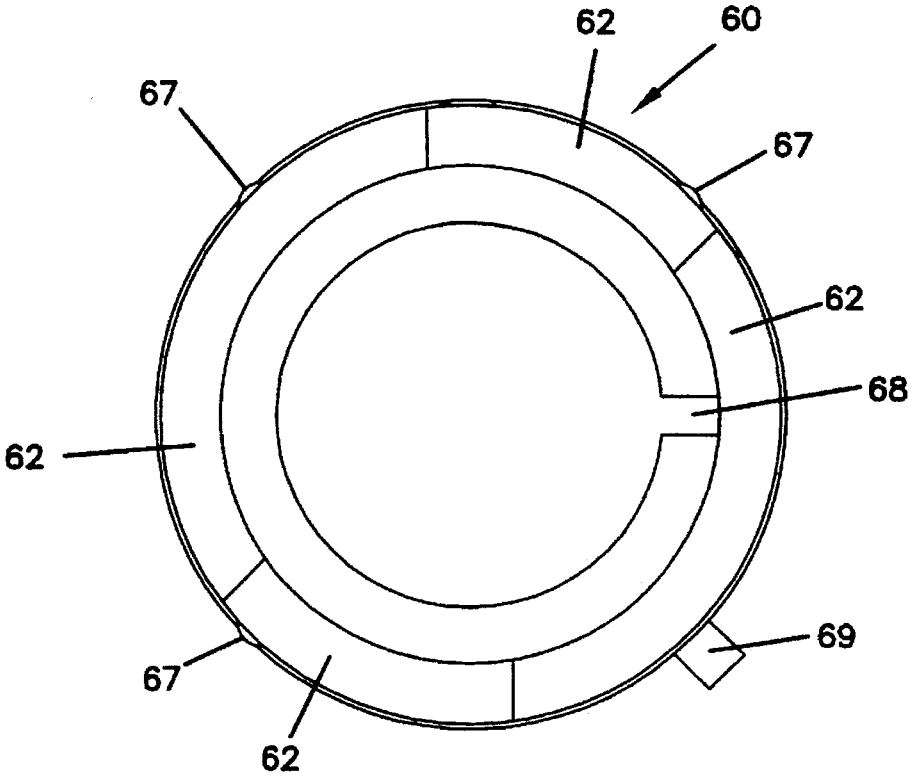
FIG. 11 shows top plan of the insert for the defeater mechanism.

The retainer 40 includes an end key portion 64 which couples to a defeater plunger member 50. The plunger member 50 includes a recess 66, as more clearly shown in FIGS. 6 and 10 to receive the end portion 64 of the retainer 40. When inserted, rotation of the retainer 40 also rotates the defeater plunger 50. The defeater plunger 50 also includes tabs 52 which extend radially outward from a lip of the plunger 50, as shown in FIGS. 7, 8 and 10. A compression spring 48 inserts into the recess 66 between the defeater plunger 50 and the end 64 of the retainer 40. The plunger member 50 is configured to slide within a cammed insert 60. The cammed insert inserts into the bore against the shoulder 74 of the bore 70. The insert 60 includes a cammed surface 62 extending annularly around the end of the insert 60 as also shown in FIG. 11. The plunger extends through the center of the insert 60 with the tabs 52 sliding along the cammed surface 62. The insert 60 includes ribs 67 and tab 69 or is otherwise configured so that it seats into the enlarged end portion 76 of the bore 70. In this manner, the insert 60 will not rotate relative to the enlarged bore 76.

A torsion spring 56 includes end tabs 58 extending axially outward. When assembled, as shown in FIG. 7, the defeater plunger 50 inserts through the insert 60 with the torsion spring 56 extending annularly around the plunger 50 inside of the insert 60. The first tab 58 of the torsion ring 50 inserts into a slot 54 formed in the defeater plunger 50, as shown in FIG. 10. The other tab 58 inserts into a slot 68 formed in the interior of the insert 60, shown in FIG. 11.

In the position shown in FIG. 7, the defeater 30 is in the locked position with the plunger member 50 inserting into recess 90 in the escutcheon 26. In this position, the tabs 52 of the defeater plunger 50 rest on the depressed portion of the cammed surface 62 of the insert 60. However, when rotated to the unlocked position, as shown in FIG. 8, the plunger tabs 52 slide upward to the raised portion of the cammed surface 62, pulling the plunger member 50 axially out of the recess 90, thereby unlocking the defeater mechanism 30. It can be appreciated that the compression spring 48 urges the plunger member 50 into the recess 90. In addition, the torsion spring 56 also resists unlocking rotation of the retainer 40 and defeater plunger 50, thereby pushing the plunger 50 to rotate to slide inward toward a locked position. In this manner, when the retainer 40 is rotated from its locked position, as shown in FIG. 7, to the unlocked position shown in FIG. 8, the springs 48 and 56 will tend to push the plunger member 50 to seat in the recess 90. In this manner, when the handle 20 is rotated, the plunger member 50 pushes against the escutcheon base 80. However, when the handle 20 is returned to its original locked position, the springs 48 and 56 will rotate the retainer 40 and plunger 50 back to their locked position and force the plunger member 50 back into the recess 90, as shown in FIG. 7. This provides for automatic locking and improved seating of the defeater mechanism 30 when in the home locked position. With the cammed surface 62, rotation of only 45 degrees is needed to fully unlock the defeater device 30. It can be appreciated that the retainer member 40 will typically have a slot for receiving a screwdriver or configured for receiving some other type of tool, as tool actuation is a common requirement for handles.

To unlock the defeater 30, the retainer 40 must be rotated to the unlocked position with the actuator tool, thereby retracting the plunger 50. The actuator tool must hold the retainer 40 in the unlocked position while the handle 22 is rotated until the plunger 50 clears the rim of the recess 90. When the handle 22 is returned to the locked position, the plunger 50 aligns with the recess 90 and the springs 48 and 56 push the plunger 50 back into the locked position extending into the recess 90.

As shown in FIG. 6, the escutcheon includes a retainer member 94 and an O-ring 90 to help seal the flat base 80 and hold the escutcheon 26 in place. In addition, an O-ring 92 seals around the spindle 28. It can be appreciated that the opposite end of the spindle 28 inserts into an extended recess 98 in the housing portion 24. The recess 98 does not extend all the way through the housing 24 so that an additional seal is not needed at the opposite end of the spindle 28.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A handle for an enclosure, comprising:

a rotatable member cylindrical housing having a grip portion, and including a spindle extending from the housing, wherein the grip portion is substantially transverse to the spindle;

handle lock receiving means located on the grip portion;

interchangeable escutcheon members including a raised annular portion around the periphery of the members mounted on the enclosure receiving the cylindrical housing, comprising a first escutcheon member selectively configured for preventing clockwise rotation of the rotatable member, the first escutcheon member having a raised lock receiving portion offset to the clockwise side of the handle lock receiving means; and a second escutcheon member selectively configured for preventing counter-clockwise rotation of the rotatable member, the second escutcheon member having a raised lock receiving portion aligned with and offset to the counter-clockwise side of the handle lock receiving means.

2. A handle according to claim 1, wherein the handle lock receiving means is radially aligned with a rotational axis of the handle.

3. A handle according to claim 2, wherein the first escutcheon means includes raised lock receiving means aligned with the handle lock receiving means on a first side of the handle lock receiving means and wherein the second escutcheon means includes raised lock receiving means aligned with the handle lock receiving means on a second side of the handle lock receiving means.

4. A latch handle apparatus, comprising:

a base portion defining a bore extending therethrough and grip portion extending substantially transverse to the bore;

an integral lock defeater device, including:

a plunger member sliding axially in the bore and rotating in the bore between a locked position and an unlocked position;

compressive biasing means engaging the plunger member and urging the plunger member toward the locked position;

torsional biasing means for biasing the plunger member to rotate toward a locked position;

a cylindrical camming member defining an axially extending camming surface including a raised portion and a depressed portion engaging a complementary camming surface formed on a ridge in the bore, wherein the camming member includes sidewalls forming an inner cavity, and wherein the camming member slides over the plunger member so that the plunger member extends into the cavity;

mounting means defining a recess receiving the plunger in the locked position.

5. A latch handle according to claim 4, including rotation limiting means for limiting rotation of the latch handle within a predetermined range.

6. A latch handle according to claim 4, further comprising a retainer member axially attached to the plunger member and configured for receiving an actuator tool.

7. A latch handle according to claim 4, wherein the camming member comprises an annular camming surface and wherein the plunger member includes tabs extending radially outward and sliding on the camming surface.

8. A lock defeater device for mounting through a bore in a housing, comprising:

a plunger member sliding axially between a locked position and a retracted position;

a retainer member for retaining the defeater device in the bore and coupled to the plunger member;

biasing means for biasing the plunger member toward a locked position; and, an annular cammed member having an axially extending cammed surface and defining a passage receiving the plunger member, and wherein the bore defines a shoulder having an axially extending annular camming surface extending around the bore.

9. A latch apparatus according to claim 8, wherein the biasing means comprises compressive and rotational biasing means.

10. A latch apparatus according to claim 9, wherein the rotational biasing means comprises a torsion spring attached to the insert and the plunger.

11. A latch apparatus according to claim 9, wherein the torsional biasing means comprises a spring inserting radially intermediate the cammed member and the plunger member.

12. A latch apparatus comprising:

a housing including a substantially cylindrical head portion and a handle portion extending substantially radially from the head portion;

wherein the head portion defines a bore extending therethrough including a first portion, a second portion narrower than the first portion and defining a shoulder extending radially to the first portion forming a cam surface, a third portion proximate the second portion and a fourth portion proximate the third portion and wider than the third portion;

a retainer rotationally mounting in the third and fourth portions rotating between a locked position and an unlocked position; the retainer including an end portion;

a lock defeater device including:

a plunger member sliding in the second portion and engaging the end portion of the retainer; wherein the plunger member slides between a locked position and an unlocked position; and wherein the plunger member defines an inner chamber;

a compressive spring extending into the inner chamber intermediate the retainer and the plunger member;

a cylindrical camming member slidably mounted in the first portion; the camming member including a camming surface engaging the cam surface of the shoulder, wherein rotation of the camming member slides the camming member axially along and at least partially out of the bore; and wherein the camming member defines an inner cavity receiving the plunger member;

a helical torsion spring in the inner cavity of the camming member and extending around the plunger member; and, a base receiving the head portion and including a recess formed therein receiving the camming member in the locked position.

* * * * *

UNITED STATES PATENT AND TRADEMARK OFFICE

CERTIFICATE OF CORRECTION

PATENT NO. : 5,634,357

DATED : June 3, 1997

INVENTOR(S) : Nutter et al.

It is certified that error appears in the above-identified patent and that said Letters Patent is hereby corrected as shown below:

Title page, item [56],

The second patent referenced in the References Cited U.S. Patents Section should read:

1,365,858 1/1921 Sells et al. ..... 70/212

Column 3, Line 45, insert --and-- after the word "centered"

Signed and Sealed this

Sixteenth Day of December, 1997

*Attest:*

*Attesting Officer*

BRUCE LEHMAN

*Commissioner of Patents and Trademarks*